United States Patent [19]

Firnhaber

[11] 4,130,420

[45] Dec. 19, 1978

[54] NICKEL-CHROMIUM ALLOYS

[76] Inventor: Miles Firnhaber, Rte. 3, Pewaukee, Wis. 53072

[21] Appl. No.: 857,125

[22] Filed: Dec. 5, 1977

[51] Int. Cl.[2] ..... C22C 19/00

[52] U.S. Cl. ..... 75/134 F; 75/171

[58] Field of Search ..... 75/171, 134 F

[56] References Cited

U.S. PATENT DOCUMENTS 3,876,423 4/1975 Firnhaber ..... 75/134 F

*Primary Examiner*—M. J. Andrews

*Attorney, Agent, or Firm*—Fred Wiviott

[57] ABSTRACT

A nickel-chromium alloy composed of the following ingredients in the following ranges of percentage by weight:

| | |
|---|---|
| Ni | 41.8 – 46.2 |
| Cr | 36.72 – 40.58 |
| W | 2.23 – 2.47 |
| Fe | 2.71 – 2.99 |
| C | .13 – .17 |
| Si | 1.23 – 1.37 |
| Mn | .99 – 1.09 |
| Co | 3.48 – 3.84 |
| Mo | 5.70 – 6.30 |

2 Claims, No Drawings

NICKEL-CHROMIUM ALLOYS

BACKGROUND OF THE INVENTION

This invention relates to improvements in nickel-chromium alloys.

In centrifuges which are used in the manufacture of glass wool, the metal from which the centrifuge is formed must be resistant to attacks by molten glass which is high in borax and soda ash. In addition it is desirable in centrifuges or rotors of this type to have a multiplicity of relatively small peripheral holes from which the molten glass is thrown by centrifugal force into the path of fiberizing jets. The alloy, therefore, must be readily machinable. A rotor of this type is disclosed in U.S. Pat. No. 3,227,536. Holes in centrifuges of this type are, of course, subject to wear and it is highly desirable to be able to provide a centrifuge which can be used for a maximum number of hours before there is objectionable wear on the holes. Another problem with metal centrifuges is that in the larger sizes there is a problem of distortion in use.

SUMMARY OF THE INVENTION

It is a general object of the present invention to provide an improved nickel-chromium alloy which is particularly suitable for use in forming centrifuges of the above type.

A further object of the invention is to provide an alloy which is highly resistant to attack by the borax and sode dash present in molten glass.

A further object of the invention is to provide an improved alloy which makes it possible to form a distortion free centrifuge in a diameter as large as 12 inches.

A further object of the invention is to provide an improved alloy, particularly adapted for use in centrifuges, which permits said centrifuge to be operated at a temperature as high as 2200° F. for a period as long as 2 hours without major deformation.

With the above and other objects in view the invention consists of the improved nickel-chromium alloy as set forth in the claims.

Centrifuges formed by the alloy of the present invention have been found to stand up longer under the conditions encountered than centrifuges formed by the alloy of U.S. Pat. No. 3,876,423, it being noted that the alloy of the present invention has substantially less nickel and substantially more chromium and molybdenum than the alloy of the prior patent.

DESCRIPTION OF THE PREFERRRED EMBODIMENT

The nickel-chromium alloy of the present invention is composed of the following ingredients in the following ranges:

| | |
|---|---|
| Ni | 41.8 - 46.2 |
| Cr | 36.72 - 40.58 |
| W | 2.23 - 2.47 |
| Fe | 2.71 - 2.99 |
| C | .13 - .17 |
| Si | 1.23 - 1.37 |
| Mn | .99 - 1.09 |
| Co | 3.48 - 3.84 |
| Mo | 5.70 - 6.30 |

The preferred formula is as follows:

| | |
|---|---|
| Ni | 44 |
| Cr | 38.65 |
| W | 2.35 |
| Fe | 2.85 |
| C | .15 |
| Si | 1.30 |
| Mn | 1.04 |
| Co | 3.66 |
| Mo | 6 |

For preparation, any of the conventional procedures for nickel alloys may be followed. For example the nickel and chromium are melted in an electric arc furnace at a temperature of about 2800°-3000° F. The other alloying elements are then added and the temperature raised to promote homogeneity.

Centrifuges manufactured by an alloy as above described were used in the manufacture of glass fibers and the centrifuges were found to stand up for an exceptionally long time against attacks by glass batches which were high in borax and soda ash. Centrifuges made with alloys in accordance with the present invention have a service life of up to 300 hours without significant wear in the peripheral apertures.

The alloy of the present invention was found to have superior creep resistance and strength at elevated temperatures and is readily machinable.

Various changes and modifications may be made in the invention heretofore described as may be within the scope of the claims.

I claim:

1. An alloy consisting of the following ingredients in percentages by weight:

| | |
|---|---|
| Ni | 41.8 - 46.2 |
| Cr | 36.72 - 40.58 |
| W | 2.23 - 2.47 |
| Fe | 2.71 - 2.99 |
| C | .13 - .17 |
| Si | 1.23 - 1.37 |
| Mn | .99 - 1.09 |
| Co | 3.48 - 3.84 |
| Mo | 5.70 - 6.30 |

said alloy being characterized by resistance to corrosive attack by molten glass, having superior creep resistance, having strength at elevated temperatures, and imparting resistance to deformation to articles made thereform.

2. An alloy in which the ingredients are in about the following percentages by weight:

| | |
|---|---|
| Ni | 44 |
| Cr | 38.65 |
| W | 2.35 |
| Fe | 2.85 |
| C | .15 |
| Si | 1.30 |
| Mn | 1.04 |
| Co | 3.66 |
| Mo | 6 |

said alloy being characterized by resistance to corrosive attack by molten glass, having superior creep resistance, having strength at elevated temperatures, and imparting resistance to deformation to articles made therefrom and resistance to cracking after prolonged exposure to elevated temperatures above 2000° F.

* * * * *